US006123106A

United States Patent [19]

Benstead

[11] Patent Number: 6,123,106

[45] Date of Patent: Sep. 26, 2000

[54] THRUST WASHER

[75] Inventor: Evan A. Benstead, Los Angeles, Calif.

[73] Assignee: Emhart Inc., Newark, Del.

[21] Appl. No.: 09/454,269

[22] Filed: Dec. 3, 1999

[51] Int. Cl.[7] ..... B67D 5/37

[52] U.S. Cl. ..... 137/801; 137/343; 137/357; 137/359; 137/454.6; 251/143; 251/152

[58] Field of Search ..... 251/143, 152; 137/801, 357, 359, 454.6, 343

[56] References Cited

U.S. PATENT DOCUMENTS

| | | | |
|---|---|---|---|
| 4,573,493 | 3/1986 | Hammarstedt . | |
| 5,009,247 | 4/1991 | Oberdörfer . | |
| 5,010,922 | 4/1991 | Agresta . | |
| 5,349,987 | 9/1994 | Shieh | 137/801 |
| 5,535,776 | 7/1996 | Kingman . | |
| 5,558,128 | 9/1996 | Pawelzik et al. . | |
| 5,562,120 | 10/1996 | Spano et al. | 137/359 |
| 5,660,203 | 8/1997 | Gnauert et al. | 137/359 |
| 5,950,663 | 9/1999 | Bloomfield | 137/359 |

*Primary Examiner*—A. Michael Chambers
*Assistant Examiner*—Thomas L. McShane
*Attorney, Agent, or Firm*—Edward D. Murphy

[57] ABSTRACT

A thrust washer for a mounting assembly disposed below an opening in a deck for mounting a faucet above the opening in the deck. A plurality of water lines extend through the opening in the deck to be connected to the faucet. The thrust washer being wider than the opening in the deck and formed in the shape of a "W" with a central opening at its midpoint for connection thereof to the mounting assembly. The thrust washer has a pair of outer legs defining wings which create an enlarged space above the central opening thereof adjacent the top of the "W". The thrust washer defines a solid, squat member having a height substantially equal to one-half the distance of the enlarged space thereof.

12 Claims, 4 Drawing Sheets

THRUST WASHER

FIELD OF THE INVENTION

The present invention relates to a thrust washer. More particularly, the present invention relates to a thrust washer that is solid and substantial, and formed with a height that is approximately one half that of the clearance space formed between the outer legs thereof.

BACKGROUND OF THE INVENTION

Thrust washers of the prior art were usually formed from sheet metal, by stamping in a "U" shape, of about 14 gauge (0.0747"). The short height and relative thin gauge led to a dual problem of the thrust washers being susceptible to bending, buckling or producing an "oilcan" effect when the thrust washer was placed under load during or after the mounting assembly of the faucet, and of the clearance space being a minimal opening, which—especially for a pull-out type faucet—can result in mounting and/or operational difficulties.

SUMMARY OF THE INVENTION

It is an object of the present invention to overcome the deficiencies of the prior art and to provide a thrust washer that is simple and economical to manufacture, easy to assemble and highly reliable in operation.

It is another object of the present invention to provide a thrust washer that is rigid, stable and strong. It is another object of the present invention to provide a thrust washer that does not bend or deflect in mounted position or, subsequently, fail during operation of the faucet.

It is still another object of the present invention to provide a thrust washer that has a height profile that facilitates the mounting assembly of the faucet to the deck, while being formed to present the strongest side to contact and absorb the forces of assembly. It is still another object of the present invention to provide an enlarged space for retaining the water lines of the faucet. It is still another object of the present invention to provide a thrust washer manufactured from sheet metal.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 6:
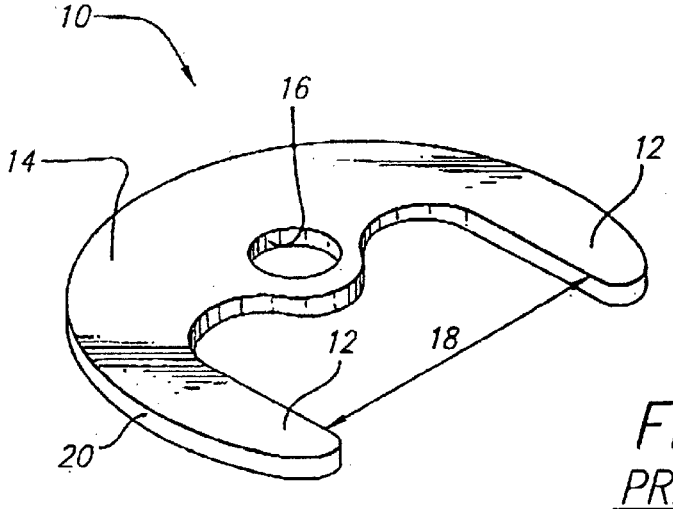
FIG. 6 PRIOR ART
FIG. 6 is a perspective view of a typical prior art thrust washer.

Referring to the drawings in which like reference numerals designate like or corresponding components throughout the several views, and turning first to FIG. 6 which shows a prior art thrust washer 10 formed in a general configuration of a "U" having mirror image outer legs 12, 12 connected to each other at the bottom thereof by a base 14, the upper end of which has a central opening 16 through which passes a mounting member (not shown). Above the opening 16 of the base 14, as shown in FIG. 6, there is a space 18 that is formed between the outer legs 12, 12. The typical thrust washer 10 may be stamped from 14 gauge sheet metal and will have a height or axial thickness 20 of about 3/16". The span 18 is equal to or slightly greater than an opening (not shown) in a deck (not shown) which the thrust washer 10 will engage, and three or four water lines (not shown) will pass into the deck opening through the span 18. There is little mounting clearance because the height 20 is relatively thin, and therefore, the connection of the mounting nut (not shown) to the mounting member is close to the deck and, for many installations, this is an added difficulty. Also, it is easy to see that the span 18 can become overcrowded so as to make installation of the water lines difficult and time consuming. Lastly, the thrust washer 10 has a section modulus that is weakest in the direction that it is formed and, therefore, it is weakest in its height 20 and this is the direction that the thrust washer 10 will be loaded. In a typical mounting, the thrust washer 10 will begin to fail anywhere between 35 to 60 in-lbs. of applied force. Upon the thrust washer 10 failing, the faucet (not shown) would become loose and unstable in its mounting so as to require remounting and/or replacement of the thrust washer 10.

Figure 1:
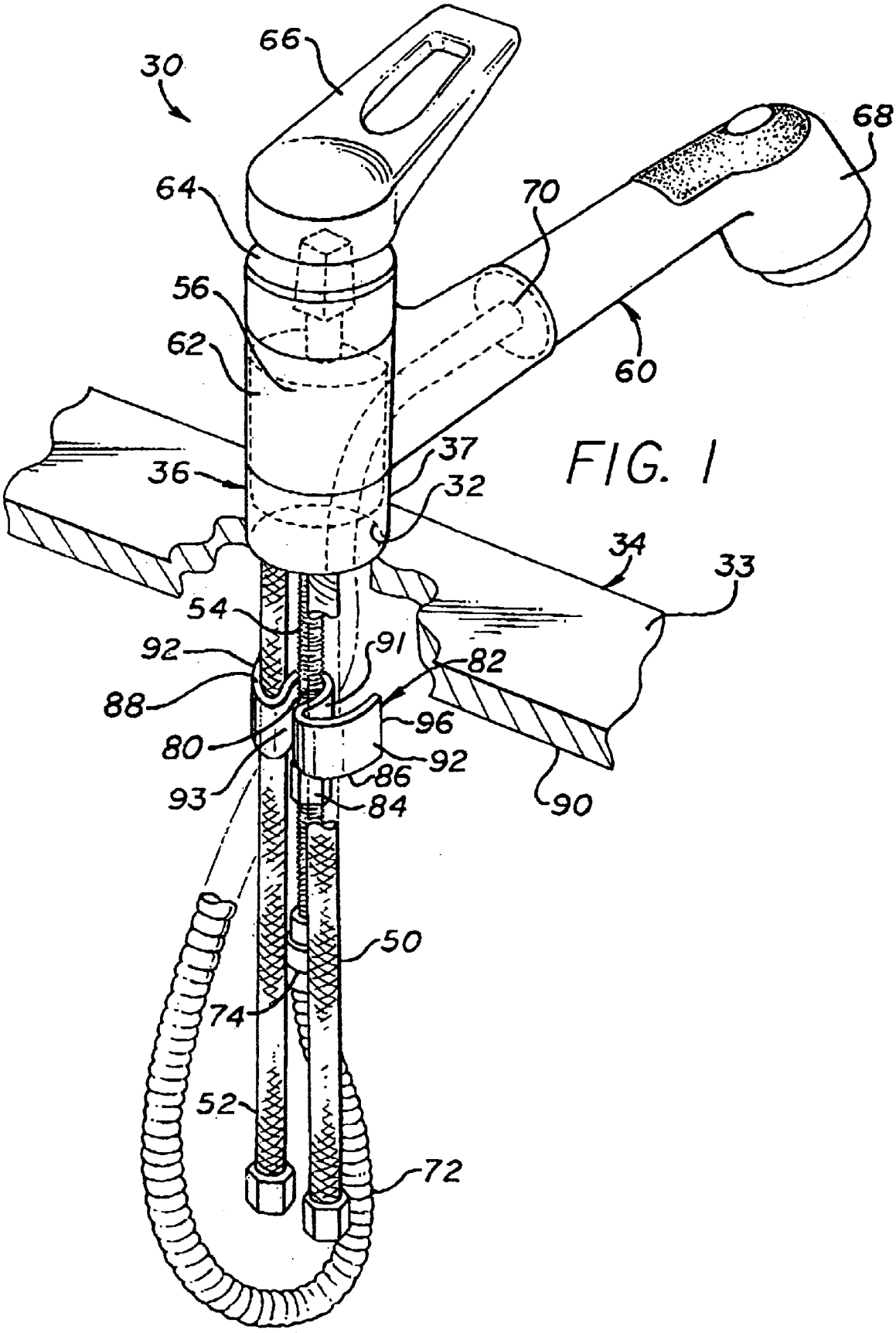
FIG. 1 is a perspective view, partly in section, of the preferred embodiment of the present invention.
Figure 2:
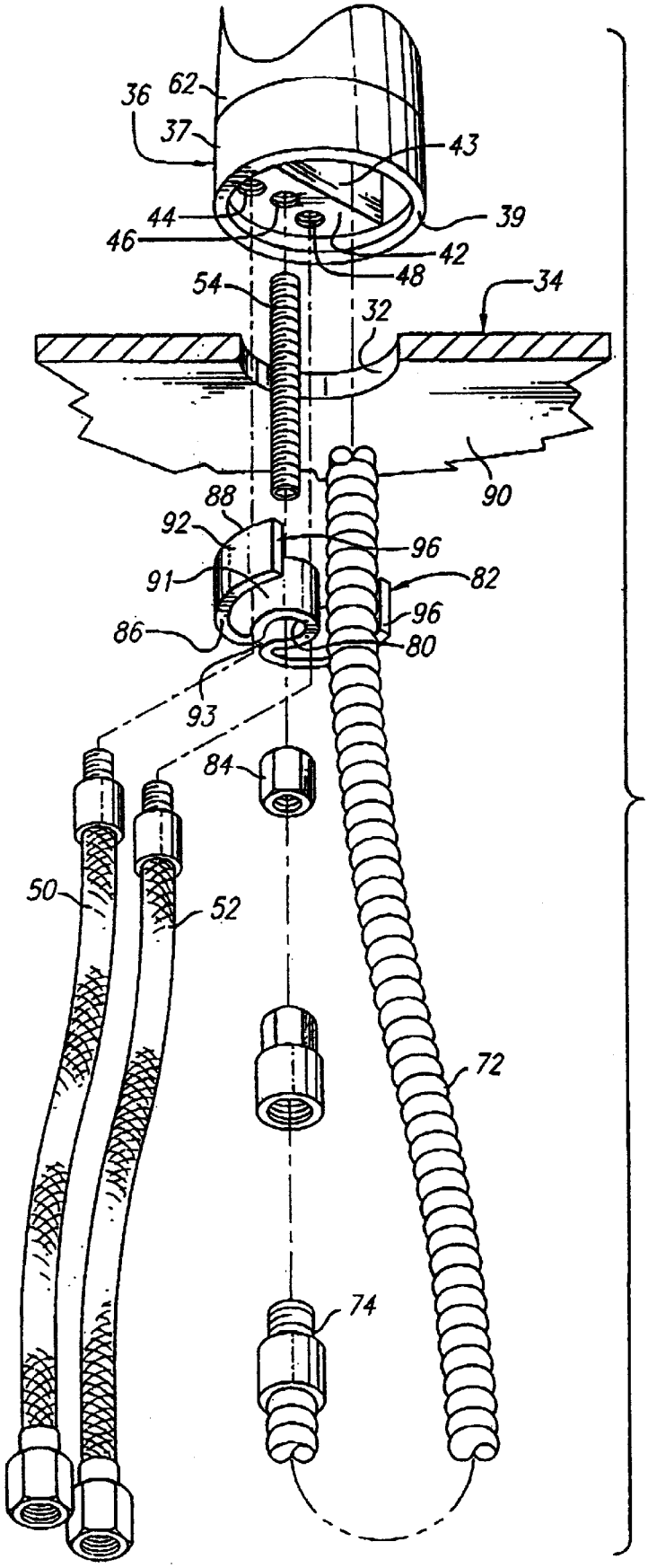
FIG. 2 is an exploded perspective view of certain components of the present invention shown in FIG. 1.
Figure 3:
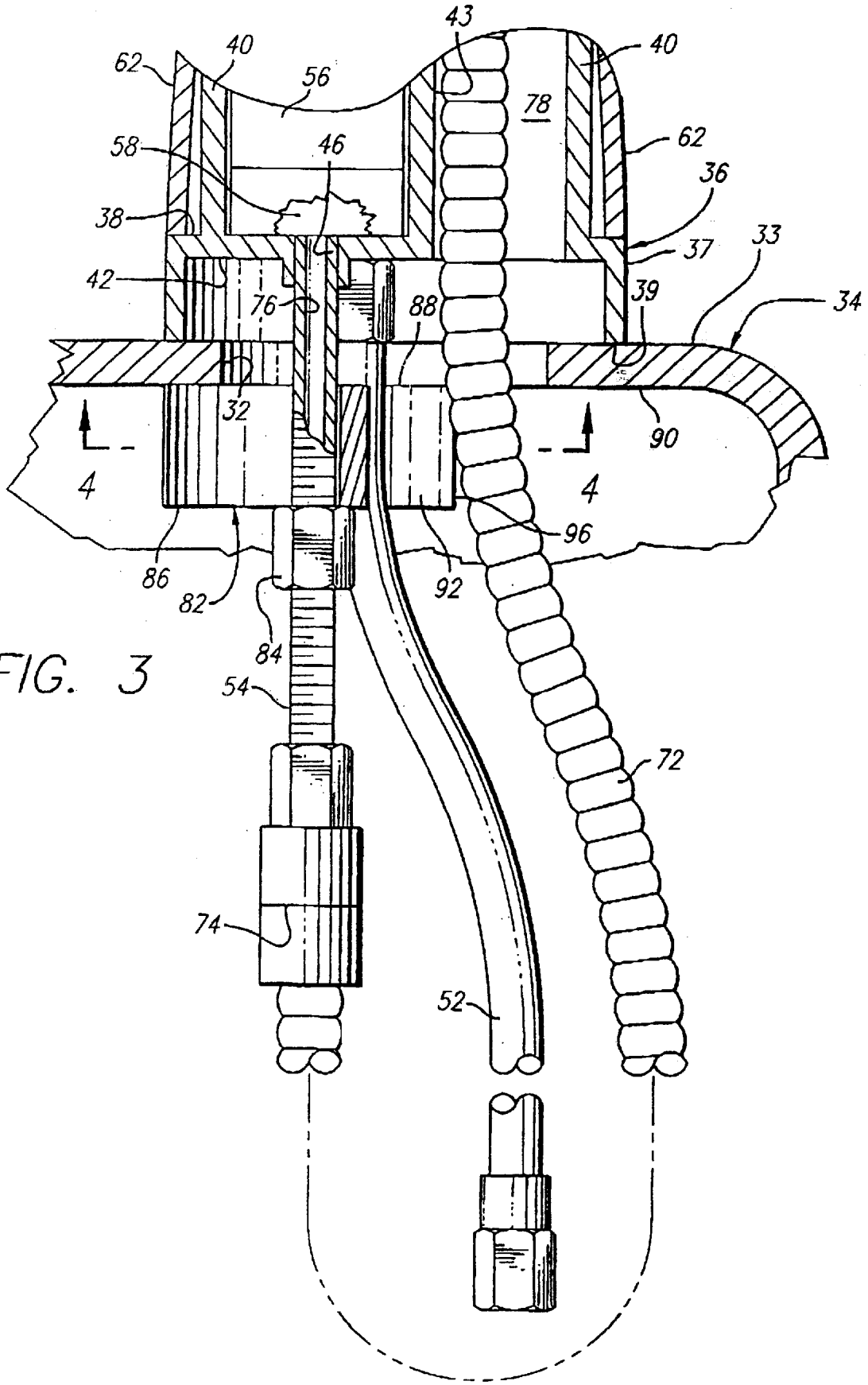
FIG. 3 is a side elevational view, partly in section, of the present invention shown in FIG. 1.
Figure 4:
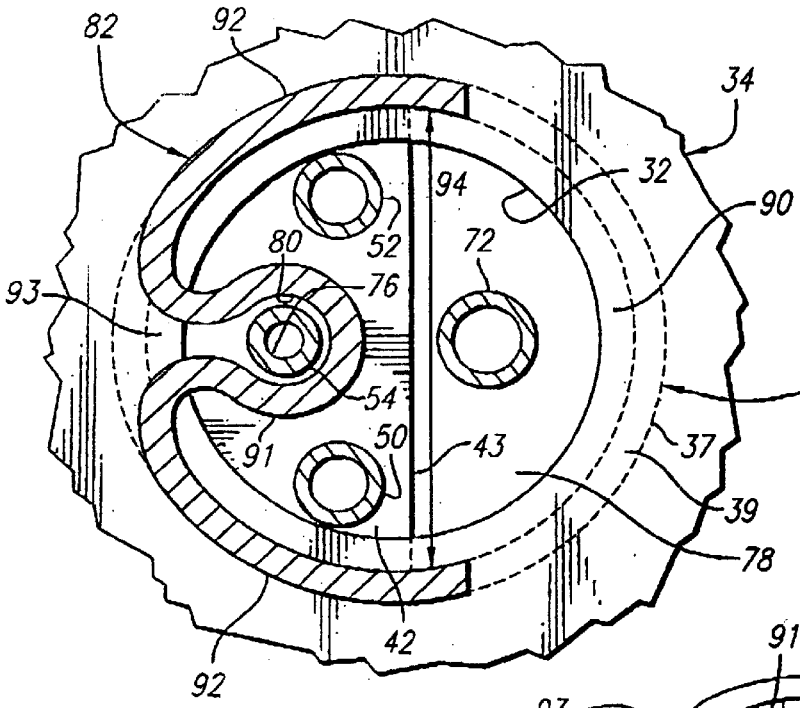
FIG. 4 is a view taken along line 4—4 of FIG. 3.

Referring to the preferred embodiment of the invention shown in FIGS. 1 through 5 of the drawings wherein a single control faucet 30, best illustrated in FIG. 1, will be mounted above an opening 32 formed in a deck 34. The faucet 30 has a housing with a cylindrical body 36, the lower portion 37 of which has an end 39 that will sit upon the upper surface 33 of the deck 34 to be mounted over the opening 32 formed in the deck 34, as shown in FIGS. 1, 2 and 3. An annular flange 38, best shown in FIG. 3, is formed at the top of the lower portion 37 of the body 36 from which an integral upper portion 40 extends from the inner annular end of the flange 38. Also, a horizontal shelf 42 is formed as an extension of the flange 38 and lies on the left side of the body 36, as best shown in FIGS. 3 and 4 to close off about half of the open space of the body 36 formed inwardly of the end 39 thereof to terminate in a vertical wall 43, shown in FIGS. 2, 3 and 4. Three tapped holes 44, 46 and 48 are formed in the shelf 42, as shown in FIG. 2, with the two outer holes 44 and 48 substantially identical, to threadedly receive a hot water supply line 50 in hole 44 and a cold water supply line 52 in hole 48. The middle hole 46 will threadedly receive an outlet tube 54 which has the dual function of also being the mounting bolt.

Figure 5:
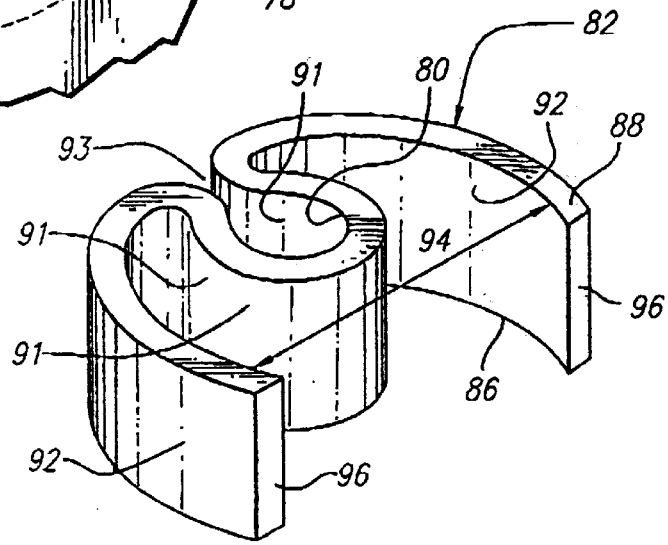
FIG. 5 is a perspective view of the preferred embodiment of the thrust washer of the present invention.

A valve cartridge 56, shown in FIGS. 1 and 3, is mounted in the housing body 36 above the shelf 42 in a conventional manner to receive and mix the water from lines 50 and 52 for delivery to an outlet water chamber 58, shown only in FIG. 3, that is formed above the outlet tube 54. A spout 60, shown only in FIG. 1, extends from a hub 62, shown in FIGS. 1, 2 and 3, and is nested on the top of the flange 38 whereby the spout 60 will be rotatable in a horizontal plane about the body 36 in a conventional manner. A cap 64, shown only in FIG. 1, is connected to the body 36 above the hub 62 to sealingly mount the valve cartridge 56 and the hub 62 of the spout 60 of the faucet 30. A handle 66, shown only in FIG. 1, is operatively connected to the valve 56 above the cap 64 to control the flow of water in the faucet 30 in the usual manner. The spout 60 has pull-out spray head 68 to which is connected one end 70 of a flexible outlet hose 72, the other end 74 of which is connected to the outlet tube 54 which has a discharge opening 76, shown only in FIG. 3, formed therein to receive the outlet water from chamber 58 for delivery to and discharge from the spout 60 in the usual manner. It is understood that the outlet hose 72 is flexible and of a substantial length sufficient to permit the spray head 68 to be removable from the spout 60 to be operated in an independent manner therefrom. The outlet hose 72 normally extends vertically downwardly from its connection with the outlet tube 54 to loop around and extend vertically upwardly into and through an open channel 78 formed in the body 36 between the upper portion 40 and the vertical wall 43 to extend into the spout 60 wherein its end 70 is connected to the spray head 68, as shown in FIGS. 1 and 3. As best shown in FIG. 3, the loop of the outlet hose 72 extends below the deck 34 beyond the dimensions of the opening 32 but below the deck 34. This is an open area from which the outlet hose 72 rises to pass outwardly of an enlarged space 94 of a novel thrust washer 82, as best shown in FIG. 5 and then to pass through the opening 32 of the deck 34 before entering into the open channel 78, as described above.

To mount the body 36 of the faucet 30 to the deck 34, as shown in FIGS. 1, 2, 3 and 4, the outlet tube 54 will be threadedly connected in the hole 48 and passed slidingly through a larger diameter central opening 80 of the thrust washer 82 that is formed in the general shape of a "W", as best shown in FIG. S. A mounting nut 84 is threadedly connected to the outlet tube 54 below the thrust washer 82 to engage an underside 86 of the thrust washer 82 when the mounting nut 84 is raised, thus, forcing an upperside 88 of the thrust washer 82 to engage an underside 90 of the deck 34 about the opening 32 therein. The novel design of the thrust washer 82 will provide an improved solid and stable mounting for the faucet 30. The novel thrust washer 82, best shown in FIG. 5, is formed in one piece from sheet metal that is stamped and subsequently bent into the desired shape. It is understood that the thrust washer 82 could alternately have been formed by extrusion or casting or in any other suitable manner or shape, such as a coiled member (not shown) having a central opening from which one or more arcuate legs extend, or the like. The side walls of the central opening 80 define short inner legs 91, 91 of the "W" and from an open bottom 93 thereof, the thrust washer 82 has a pair of arcuate outer legs 92, 92 with an enlarged space 94 formed therebetween above the top of the central opening 80. The thrust washer 82 has a height 96 that lies between the underside 86 and the upperside 88 thereof that is substantially five times the height 20 of the prior art thrust washer 10. Also, the height 96 is about one-half that of the clearance space 94. While the thickness of the sheet metal from which the thrust washer 82 is formed may be substantially equal to the height or axial thickness 20 of the thrust washer 10, the section modulus of the thickness 96 of the thrust washer 82 will be much greater than that of the thrust washer 10. The thrust washer 82 is formed in a direction that is perpendicular to the application of the load and, therefore, in service it will have a high section modulus in the direction of loading it will experience. On the other hand, the prior art thrust washer is formed in the direction of its loading so that it will have a section modulus in the direction of loading. In other words, the prior art thrust washer will be "weak" because the section modulus of a component is always weakest in the direction in which it is formed. For example, a typical prior art thrust washer, such as the thrust washer 10, will begin to fail after the application of between 35 to 60 in-lbs. This creates an installation dilemma, in that the tightening of the mounting nut must be within an acceptable range because if not tightened enough, the faucet 30 will be loosely mounted, but if tightened too much the mounting will produce a failure of the thrust washer 10, as by an "oilcan" effect, or it otherwise bending or deforming. Once failure occurs, the faucet 30 will become loose in it mounting. These prior art problems are avoided with the use of the novel thrust washer 82, in that this thrust washer will bear the application of 300 in-lbs. of torque before beginning to fail. This is much higher than would be likely to be applied in service, since, after about 80–90 in-lbs., the faucet 30 will be solidly mounted and quite stable and serious effort would be required to tighten the faucet 30 mounting beyond between 150–175 in-lbs. Also, because the height 96 of the thrust washer 82 is substantial, the mounting nut 84 remains about one inch from the underside 90 of the deck 34 and awkward assembly positions for the installer are avoided, which was not always the case with the use of the typical thinner (3⁄16") prior art thrust washers.

Another substantial improvement in the novel thrust washer 82 is the enlarged space 94 created between the adjacent arcuate outer legs 92, 92. The straight side of legs 12, 12 of the prior art thrust washer 10 provided both a shorter dimension of the span 18 than that of the space 94 and a smaller overall clearance area than that of the novel thrust washer 82. The two water lines 50 and 52 are trapped in the enlarged space 94 of the novel thrust washer 82, while slide mount disposition of the outlet tube 54 in the central opening 80 thereof provides for the third of the four water lines, with the fourth, the outlet hose 72 disposed at the top of the space 94 but well within the open channel 78 all of the water lines are provided for in a way that does not interfere with the mounting of the faucet 30. The opening 32 in the deck 34 is fixed and usually sized between 1.250" to 1.630", while the lines 50, 52 and 54 will be sized between 0.380" to 0.475" and the outlet hose 72 of the pull-out type faucet 30 depicted in the drawings of the present invention will be sized between 0.500" to 0.650". Because of the fixed size of the opening 32 in the deck 34 and in order to facilitate installation and operation of the faucet 30, it is necessary to provide a thrust washer 82 that is both strong and offers a maximum of clearance, both in and radially outwardly of the enlarged space 94 that is disposed immediately below the open channel 78. Thus the thrust washer 82 aids both during the mounting assembly of the faucet 30 and in the normal operation thereof and by retaining the placement of the lines 50, 52 and 54, and enabling the free movement of the outlet hose 72 during operation of the pull-out feature of the spray head 68.

While a preferred embodiment has been described above, it will be readily apparent to those skilled in the art that many modifications, substitutions and alternatives may be made without departing from the spirit and scope of the present invention. Therefore, it is intended that the scope of the present invention should not be limited by the description of the preferred embodiment, but only by the claims that follow.

What is claimed is:

1. A thrust washer for a mounting assembly disposed below an opening in a deck for mounting a faucet above the opening in the deck, a plurality of water lines extending through the opening in the deck to be connected to the faucet, with the thrust washer comprising:

a. the thrust washer having a width greater than the opening in the deck;

b. the thrust washer formed in the shape of a "W" with a central opening at it's midpoint for connection thereof to the mounting assembly;

c. the thrust washer having a pair of outer legs defining wings which create an enlarged space about the central opening thereof adjacent the top of the "W"; and d. the thrust washer having a height substantially one-half the distance of the enlarged space thereof to define a solid, squat member.

2. The combination claimed in claim 1 wherein the ratio of the central opening of the thrust washer to that of the height thereof is substantially 2:1.

3. The combination claimed in claim 2 wherein the ratio of the central opening of the thrust washer to that of the length of each of the legs is substantially 1:0.75.

4. The combination claimed in claim 3 wherein:

a. the legs having a predetermined thickness;

b. the ratio of the diameter of the central opening to that of the predetermined thickness of the legs is in the range of 3:1 to 4:1; and c. the ratio of the height of the thrust washer to that of the predetermined thickness of the legs is substantially 8:1.

5. The combination claimed in claim 4 wherein the ratio of the central opening of the thrust washer to that of the predetermined thickness of the legs is substantially 4:1.

6. The combination claimed in claim 5 wherein each of the outer legs of the thrust washer is shaped acrcuately about the central opening of the thrust washer.

7. The combination claimed in claim 6 wherein the thrust washer is formed in the shape of a single member having a plurality of arcuate bends.

8. The combination claimed in claim 7 wherein the thrust washer having a substantially uniform thickness throughout.

9. The combination claimed in claim 8 wherein the central opening of the thrust washer is formed substantially circular with an open bottom having a thickness substantially equal to the predetermined thickness of the legs.

10. A faucet mounting assembly for a single handle faucet mounted over an opening in a deck comprising:

a. a housing of the faucet disposed above the deck;

b. a valve cartridge mounted in the housing and operative responsive the handle;

c. a hot water supply line and a cold water supply line extending through the opening in the deck to be connected to the valve cartridge;

d. an outlet tube extending through the opening in the deck and threadedly connected to the housing above the deck;

e. a spout connected to the housing and in communication with the outlet tube to discharge outlet water which the outlet tube receives from the valve cartridge;

f. a nut threadedly connected to the outlet tube below the deck;

g. a thrust washer carried by and axially shiftable upon the outlet tube responsive to the axial position of the nut thereon whereby on raising the nut the thrust washer to engage the deck and clamp the faucet in mounted position;

h. the thrust washer having a width greater than the opening in the deck and formed in the shape of a "W" having a central opening at its mid-point through which passes the outlet tube; and i. the thrust washer having a pair of outer legs which define arcuate wings which create an enlarged space about the central opening thereof, and into which is disposed the hot water supply line and the cold water supply line.

11. The combination claimed in claim 10 wherein the height of the thrust washer is equal to substantially one-half of the opening of the enlarged space formed above the central opening therein.

12. The combination claimed in claim 11 wherein:

a. the spout having an end portion defining a pull-out sprayhead; and b. a flexible line connected between the outlet tube and the sprayhead and to be shiftably disposed in and through the thrust washer and the opening in the deck.

* * * * *